US010501923B2

(12) United States Patent
Bauer et al.

(10) Patent No.: US 10,501,923 B2
(45) Date of Patent: Dec. 10, 2019

(54) METHOD AND APPARATUS FOR CONTROLLING A WASTE OUTLET OF A TOILET

(71) Applicant: B/E AEROSPACE, INC., Wellington, FL (US)

(72) Inventors: Robert Bauer, Rockford, IL (US); Bradley J. Buniak, Schaumburg, IL (US); Alan L. White, Rockton, IL (US)

(73) Assignee: B/E Aerospace, Inc., Winston-Salem, NC (US)

( * ) Notice: Subject to any disclaimer, the term of this patent is extended or adjusted under 35 U.S.C. 154(b) by 0 days.

(21) Appl. No.: 15/595,495

(22) Filed: May 15, 2017

(65) Prior Publication Data

US 2018/0292022 A1 Oct. 11, 2018

Related U.S. Application Data

(60) Provisional application No. 62/483,734, filed on Apr. 10, 2017.

(51) Int. Cl.
*E03D 11/10* (2006.01)
*E03D 5/09* (2006.01)
*E03F 1/00* (2006.01)

(52) U.S. Cl.
CPC ..... *E03D 11/10* (2013.01); *E03D 5/09* (2013.01); *E03F 1/006* (2013.01)

(58) Field of Classification Search
CPC . E03F 1/006; E03D 11/10; E03D 5/09; F16K 31/54; F16K 31/53; F16K 31/535; F16K 3/04; B64D 11/02
(Continued)

(56) References Cited

U.S. PATENT DOCUMENTS 85,192 A * 12/1868 Wellington ..... E03D 11/10 4/442
251,999 A * 1/1882 Daggett ..... E03D 11/10 4/441

(Continued)

FOREIGN PATENT DOCUMENTS

WO WO-2010/039916 A1 4/2010

OTHER PUBLICATIONS

International Search Report and Written Opinion on International Patent Application No. PCT/US2018/026765 dated Sep. 27, 2018. 21 pages.

(Continued)

*Primary Examiner* — Erin Deery
(74) *Attorney, Agent, or Firm* — Donna P. Suchy

(57) ABSTRACT

An apparatus for controlling a waste outlet of a toilet includes a flush handle that is rotated by a user. A valve pinion arm is coupled to the flush handle and a waste discharge valve disposed at the waste outlet of the toilet is coupled to the valve pinion arm at an opposite end. The rotation of the flush handle is configured to move the valve pinion arm in a first direction. The movement of the valve pinion arm is configured to move the waste discharge valve to an open position. Upon release of the flush handle, the valve pinion arm is configured to move in a second direction and to move the waste discharge valve to a closed position. According to an embodiment, the apparatus includes an actuated flush control mechanism and a manual flush control mechanism.

20 Claims, 5 Drawing Sheets

(58) Field of Classification Search
USPC ..... 251/301, 303; 4/316, 422, 434, 438, 441
See application file for complete search history.

(56) References Cited

U.S. PATENT DOCUMENTS

| | | | | | |
|---|---|---|---|---|---|
| 3,038,169 | A | | 6/1962 | O'Brien | |
| 3,193,846 | A | | 7/1965 | Lefebvre | |
| 3,214,772 | A | * | 11/1965 | Roberts | E03D 1/286 4/438 |
| 3,835,479 | A | * | 9/1974 | Milette | E03D 5/012 251/279 |
| 4,155,129 | A | * | 5/1979 | Russell | E03D 3/02 4/424 |
| 4,185,340 | A | * | 1/1980 | Sargent | E03D 5/09 4/300 |
| 4,240,167 | A | | 12/1980 | Gilliland | |
| 4,275,470 | A | | 6/1981 | Badger et al. | |
| 4,376,315 | A | | 3/1983 | Badger et al. | |
| 4,637,079 | A | * | 1/1987 | Hodge | E03D 11/00 251/326 |
| 4,693,447 | A | | 9/1987 | Perez | |
| 4,783,859 | A | | 11/1988 | Rozenblatt et al. | |
| 4,787,103 | A | * | 11/1988 | Endo | E03D 11/10 277/625 |
| 4,974,264 | A | * | 12/1990 | Brian | E03F 1/006 4/300 |
| 5,060,320 | A | * | 10/1991 | Sargent | E03D 5/012 4/249 |
| 5,191,662 | A | | 3/1993 | Sharrow | |
| 5,548,850 | A | * | 8/1996 | Geeham | E03D 1/145 4/249 |
| 5,680,879 | A | | 10/1997 | Sheih et al. | |
| 6,006,373 | A | | 12/1999 | Hoang | |
| 6,385,789 | B1 | | 5/2002 | Pondelick et al. | |
| 6,618,864 | B2 | | 9/2003 | Veal | |
| 6,659,420 | B2 | | 12/2003 | Hwang et al. | |
| 6,757,919 | B2 | | 7/2004 | Snyder | |
| 7,367,541 | B2 | | 5/2008 | Muderlak et al. | |
| 7,510,166 | B2 | | 3/2009 | Maercovich et al. | |
| 8,607,370 | B2 | | 12/2013 | Hoang et al. | |
| 8,695,125 | B2 | * | 4/2014 | Funari | E03D 5/105 251/129.04 |

OTHER PUBLICATIONS

Partial International Search Report and Written Opinion on International Patent Application PCT/US2018/026765 dated Jul. 31, 2018. 13 pages.

* cited by examiner

METHOD AND APPARATUS FOR CONTROLLING A WASTE OUTLET OF A TOILET

CROSS-REFERENCE TO RELATED APPLICATIONS

The present application claims the priority benefit of U.S. Provisional Patent Application No. 62/483,734, filed on Apr. 10, 2017 and incorporated herein by reference.

FIELD OF THE DISCLOSURE

The present disclosure relates generally to toilets, and more particularly, a method and apparatus for controlling a waste outlet of a toilet.

BACKGROUND

Designing a toilet for an aircraft poses challenges that do not generally occur in ground-based toilet designs. For instance, in an aircraft, space and weight are at a premium, and using regular water-flush toilets is not practical. Also, treating malfunctions such as clogs or electrical failure is much more difficult, since space restrictions make access to plumbing nearly impossible. Moreover, a malfunction in the operation of the toilet due to electrical failure renders the toilet inoperable until the aircraft is grounded for an extended period of time for maintenance and/or replacement of the toilet.

DRAWINGS

While the appended claims set forth the features of the present techniques with particularity, these techniques may be best understood from the following detailed description taken in conjunction with the accompanying drawings of which:

Figure 1:
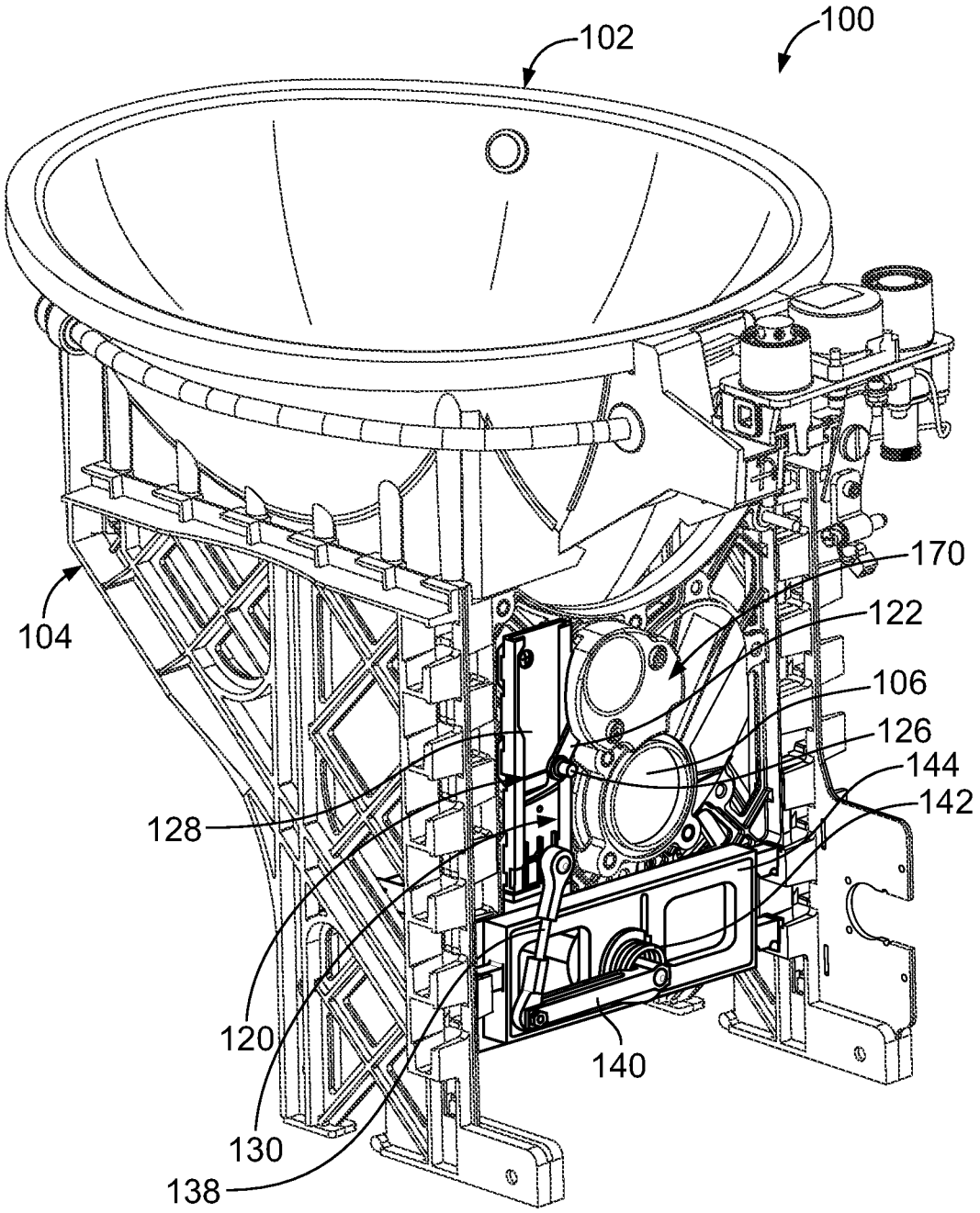
FIG. 1 is a perspective view of a toilet configured according to an embodiment.

FIGS. 3A, 3B, 3C, and 3D are perspective views of the toilet of FIG. 1, according to an embodiment.

Figure 4:
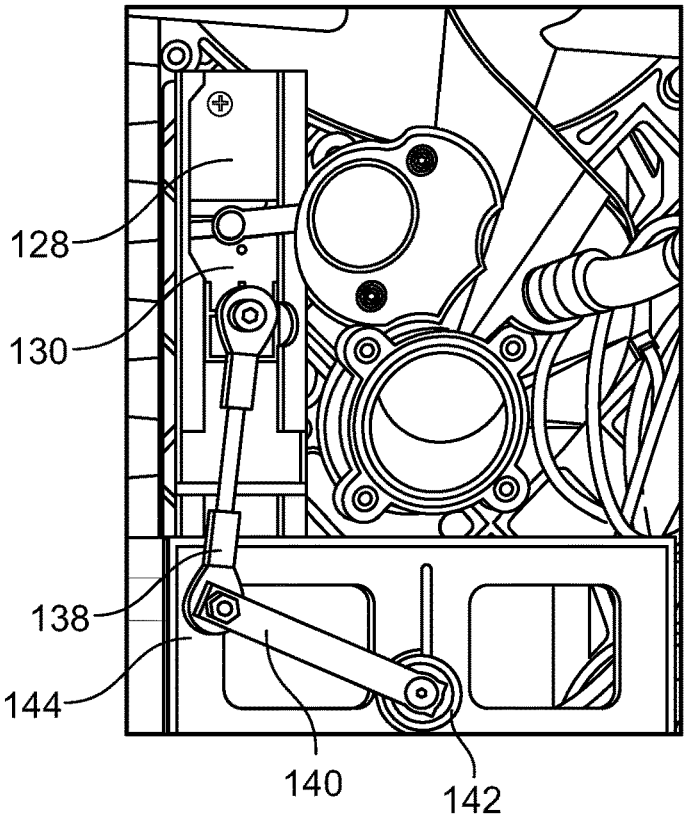

FIG. 4 is a back view of a toilet configured according to an embodiment.

Figure 5:
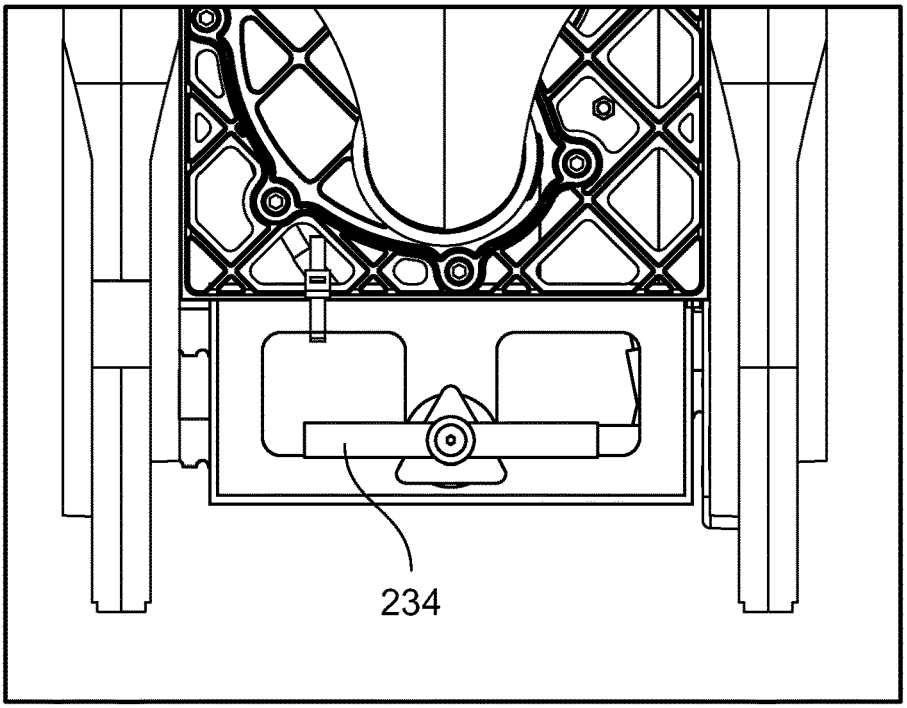

FIG. 5 is a front view of a toilet configured according to an embodiment.

Figure 6A:
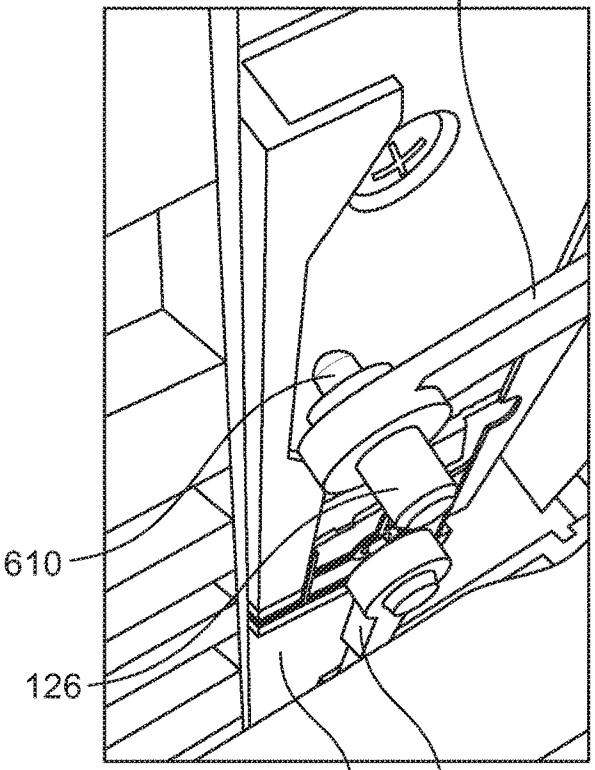
Figure 6B:
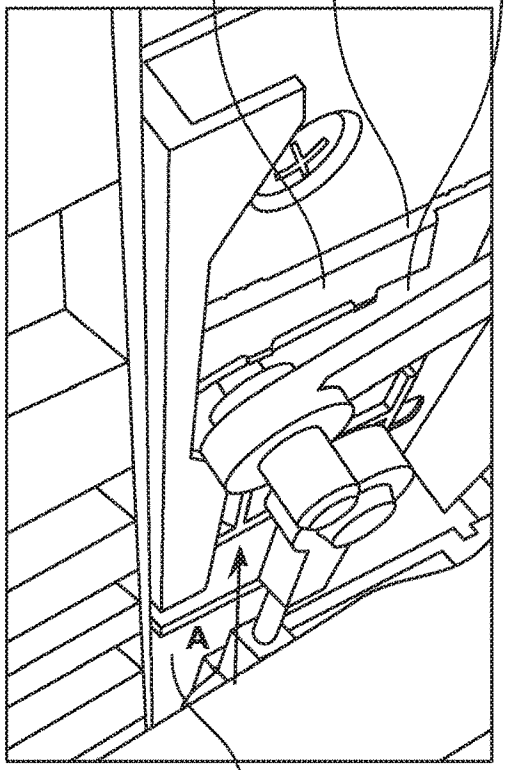
Figure 6C:
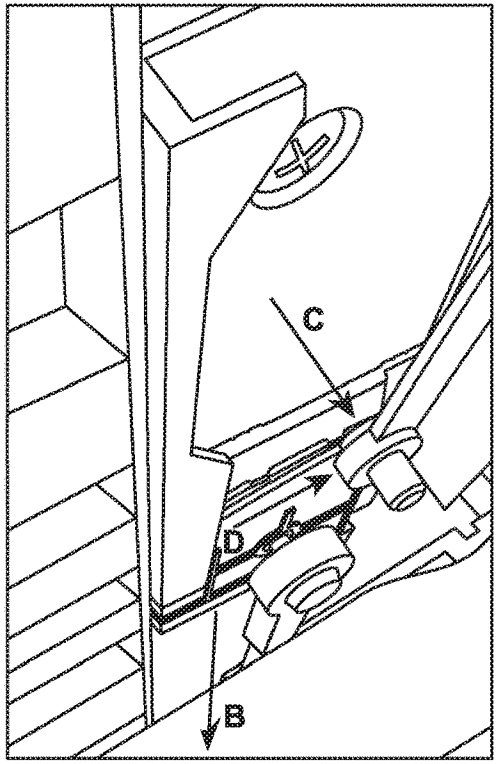

FIGS. 6A, 6B, and 6C are enhanced views of the carriage according to an embodiment.

DETAILED DESCRIPTION

The disclosure is generally directed to a method and apparatus for controlling a waste outlet of a toilet. According to an embodiment, the apparatus includes a flush handle that is rotated by a user. A valve pinion arm is coupled to the flush handle and a waste discharge valve disposed at the waste outlet of the toilet is coupled to the valve pinion arm at an opposite end. The rotation of the flush handle is configured to vertically move the valve pinion arm in an upward direction. The vertical upward movement of the valve pinion arm is configured to move the waste discharge valve to an open position. Upon release of the flush handle, the valve pinion arm is configured to vertically move in a downward direction and to move the waste discharge valve to a closed position. According to an embodiment, the apparatus includes an automatic flush control mechanism and a manual flush control mechanism.

In an embodiment, the method for controlling the waste outlet of a toilet comprising a flush handle, a valve pinion arm coupled to the flush handle, and a waste discharge valve coupled to the valve pinion arm, includes rotating the flush handle in a first direction, translating a rotational movement of the flush handle to a vertical movement of the valve pinion arm thereby rotating the valve pinion arm, and controlling the waste discharge valve to go from a closed position to an open position via the vertical movement of the valve pinion arm.

Figure 2:
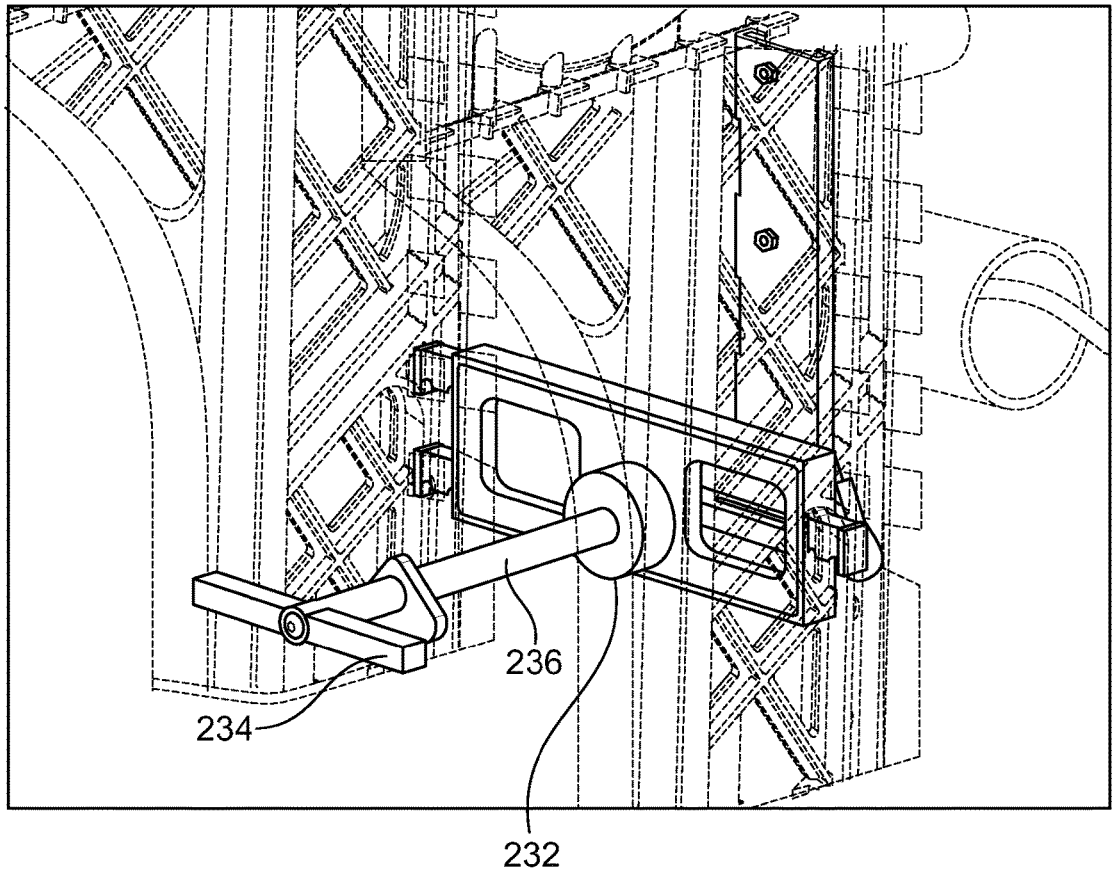
FIG. 2 is a front view of a toilet configured according to an embodiment.

Turning to FIGS. 1 and 2, a toilet configured according to an embodiment is shown. The toilet, generally labeled 100, is configured to be deployed on an aircraft, and may be housed within an external housing (not shown). The toilet 100 includes a bowl 102 attached to a frame 104. The toilet 100 also includes a waste pipe attached to the waste outlet (not shown) of the toilet bowl 102 and a manual flushing apparatus (generally labeled 120) attached to the frame 104. The manual flushing apparatus 120 operates to open or close a waste discharge valve of the waste outlet (shown in further detail in FIGS. 3A-3D). In addition to the manual flushing apparatus 120, a motor-driven flushing apparatus 170 may also be provided.

The manual flushing apparatus 120 includes a valve linkage arm 122 coupled to the waste discharge valve 106 of the waste outlet. According to one embodiment, the valve linkage arm 122 is a first valve pinion and may be coupled to a second valve pinion. According to the one embodiment, the second valve pinion may be coupled to the waste discharge valve 106. The valve linkage arm 122, at one end, interfaces with the waste discharge valve 106 through two gears (not shown). The manual flushing apparatus 120 additionally includes a spring plunger 126 provided on the valve linkage arm 122, a rail 128 and a carriage 130 configured to slide in a linear manner within the rail 128, and a front guide 232. The manual flushing apparatus 120 is actuated by a flush handle 234 (illustrated more clearly in FIG. 2). The flush handle 234 is connected to the carriage 130 via a handle shaft 236, linkage 138, and a cam arm 140. A torsion spring 142 is provided in a back support 144 connected to the frame 104 and is configured to bias the cam arm 140 in a direction to close the waste discharge valve 106.

The operation of the manual flushing apparatus 120 and its components will be further described with reference to FIGS. 2 and 3A-3D. Certain features of the toilet have not been illustrated for the sake of clarity. Turning again to FIG. 2, a front view of the toilet configured according to an embodiment is illustrated. The flush handle 234 is provided at a lower middle portion of the frame 104 in an embodiment. Of course, a person skilled in the art will appreciate that the flush handle 234 may be positioned at any location on the front side of the frame 104. Other means of rotating the cam arm 140 may also be employed from the top, side, or bottom of the toilet. In an embodiment, additional support elements (not illustrated in the drawings for the sake of clarity) may be provided to provide support for the handle shaft 236.

Figure 3B:
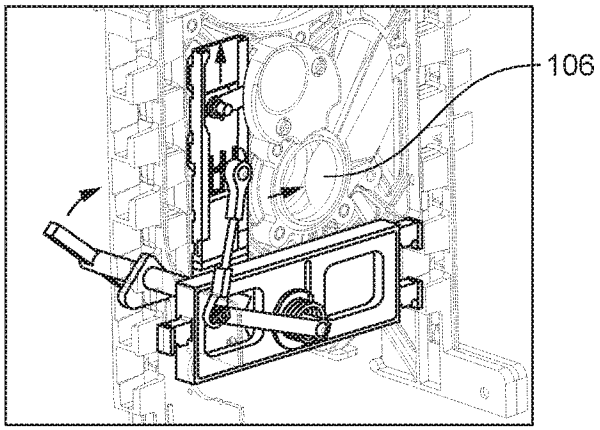
Figure 3D:
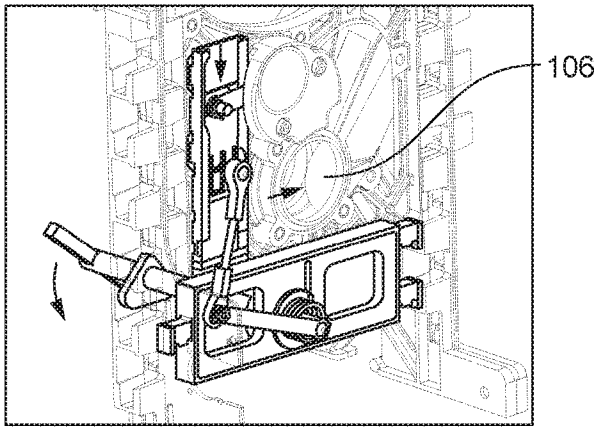
Figure 3A:
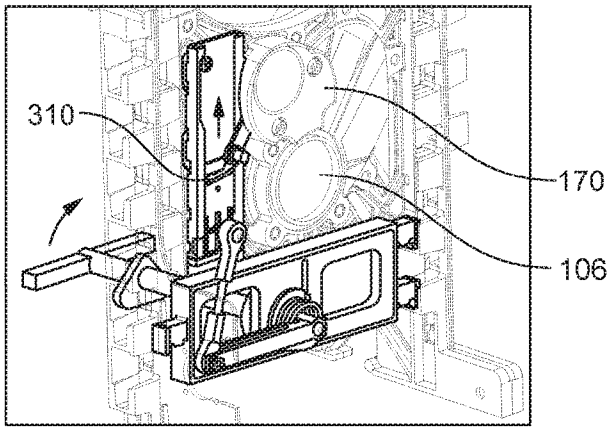
Figure 3C:
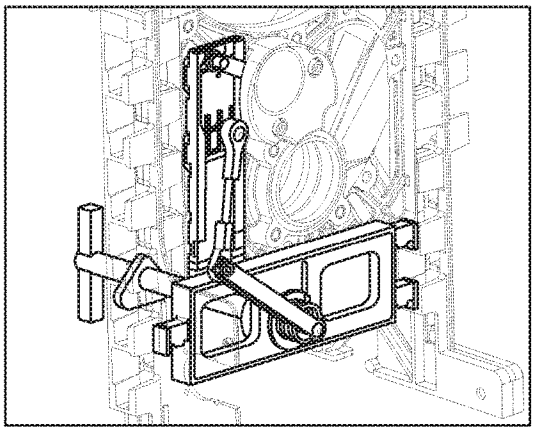

Turning now to FIGS. 3A-3D, according to an embodiment, a user operates the waste discharge valve 106 by rotating the flush handle 234 in counter-clockwise direction (when viewed from the front of the toilet) to a predetermined angle. A skilled artisan will understand that the manual flushing apparatus 120 may be configured to be actuated by rotating the flush handle 234 in a clockwise direction in other embodiments. According to an embodiment, the predetermined angle may be approximately 60 degrees. The flush handle 234 may be rotated with the waste discharge valve 106 fully closed (as illustrated in FIG. 3A), in a partial position in between (as illustrated in FIGS. 3B and 3D), or fully open (as illustrated in FIG. 3C), or any position between open and closed. According to an embodiment, a motor-driven flushing apparatus 170 is attached to the frame 104, and the motor-driven flushing apparatus 170 has a slot that contains the waste discharge valve 106.

According to an embodiment, when the user rotates the flush handle 234, the carriage 130 slides up within the rail 128 while engaging the valve linkage arm 122 via a track 310 provided on the carriage 130. The engagement between the track 310 of the carriage 130 and the valve linkage arm 122 will now be described with reference to FIGS. 6A, 6B, and 6C. As illustrated in FIG. 6A, a spring plunger 126 is disposed at an end of the valve linkage arm 122. The spring plunger 126 has a pin 610 provided at an end which is configured to slide within the track 310 of the carriage 130.

FIG. 6A illustrates an embodiment in which the valve linkage arm 122 is positioned in an intermediate position in which the waste discharge valve 106 is halfway open (corresponding to the position of the waste discharge valve 106 illustrated in FIGS. 3B and 3D), and the pin 610 is not engaged with the track 310. As illustrated in FIG. 6B, the carriage 130 has a horizontal face 630 and a sloped face 640 on the one end closest to the track 310. When the handle 234 is rotated in a counter-clockwise direction, the cam arm 140 pushes the linkage 138 in the direction of arrow A The linkage 138, in turn, pushes the carriage 130 linearly in the direction of arrow A (in an upward direction). As the carriage 130 moves in the direction of arrow A, the pin 610 slides up the sloped face 640 of the carriage 130 and falls into the track 310 as illustrated in FIG. 6B. Once the pin 610 falls within the track 310, the track 310 constrains the motion of the pin 610 such that the pin 610 moves in a direction corresponding to the movement of the carriage 130, thereby moving (e.g., rotating) valve linkage arm 122. Additionally, the pin 610 slides within the track from right to left (or vice versa) to accommodate the rotation of the valve linkage arm 122.

For instance, in the embodiment illustrated in FIG. 6C, when the carriage 130 moves in the direction of arrow B (such as when it returns to an initial position), the pin 610 also moves, thereby causing the valve linkage arm 122 to rotate in the direction of arrow C as the pin 610 slides within the track 310 from a left side of the track 310 to a right side of the track 310 (in the direction of arrow D).

Returning to FIG. 3A, the valve linkage arm 122 is illustrated in an initial position where the pin 610 is positioned at the right side of the track 310. At this time, the waste discharge valve 106 is completely closed. As the handle 234 is rotated in a counter-clockwise direction as shown in FIG. 3B, the carriage 130 slides in an upward direction. As illustrated more clearly in FIG. 1, the carriage 130 is attached to the flush handle 234 via a linkage 138 and a cam arm 140, and a handle shaft 236. The carriage 130 is restrained to vertical linear motion via the rail 128. At this time, the pin 610 slides within the track 310 from the right side of the track 310 towards the left side of the track 310. When the flush handle 234 is fully rotated in the counter-clockwise direction, the carriage 130 reaches the top portion of the rail 128, the valve linkage arm 122 is simultaneously moved upward in accordance with the movement of the pin 610 within the track 310 to the left end of the track 310. This arrangement is illustrated in FIG. 3C. At this time, the waste discharge valve 106 is in a completely open state and the contents of the bowl 102 are evacuated.

After waiting a sufficient period of time, the user releases the flush handle and the mechanism closes the waste discharge valve 106. More specifically, when the user releases the flush handle 234, the carriage 130 slides downward as shown in FIG. 3D. At this point, when the flush handle 234 is released, the handle rotates in a clockwise direction and the carriage 130 slides vertically in a downward direction within the rail 128. The pin 610 connected to the valve linkage arm 122 slides within the track 310 toward the right end of the track 310, thereby bringing the valve linkage arm 122 downward and closing the waste discharge valve 106. In an embodiment, the right end of the track includes a notch portion where the pin 610 exits the track 310.

The waste discharge valve 106 therefore begins to move to the closed position as shown in FIG. 3D as a result of the downward movement of the valve linkage arm 122. As discussed above, the valve linkage arm 122, at one end, interfaces with the waste discharge valve 106 through two gears (not shown). A person skilled in the art will appreciate that any number of gears may be provided to control the operation of the waste discharge valve 106. In various embodiments, other mechanisms may be used to interface the movement of the valve linkage arm 122 and the waste discharge valve 106. In an embodiment, the waste discharge valve 106 and the valve linkage arm 122 may be the same component.

According to an embodiment, the rotational motion of the handle shaft 236 is constrained by the front guide 232 and the back support 144. A torsion spring 142 is installed around the handle shaft 236 within the back support 144 to provide the torsion required to automatically close the waste discharge valve 106 and return the flush handle 234 to the non-operational position. The torsion spring 142 is installed with an applied load to secure the carriage 130 in the non-operational position.

After use, the mechanism automatically returns to a non-operational state, allowing the toilet to operate automatically via an actuator or another manual flush. The operation works with ambient or differential pressures. The vacuum toilet manual flush control therefore provides a method to manually open and close the vacuum toilet waste discharge valve 106 in the event of toilet power loss, or an improper system shut off This function is achieved with no additional moving parts during normal vacuum toilet operation. In addition, the mechanism serves to close the waste discharge valve 106, if it fails to close during normal operation.

According to an embodiment, the manual flush control apparatus 120 actuates the waste discharge valve 120 without the use of a clutch. There is no operation of the manual override components unless a manual override is initiated by the user. The flush handle 234 uses rotational motion instead of a linear motion to actuate the waste discharge valve 106 according to an embodiment. The manual flush control apparatus 120 has the ability to open the waste discharge valve 106 from any fully open, fully closed, or partially open position. Once engaged, the manual flush control apparatus 120 automatically closes the waste discharge valve 106. According to various embodiments, the manual flush control apparatus 120 does not inhibit the normal operation of the toilet.

FIG. 4 illustrates a back view of the toilet according to an embodiment. When the user rotates the handle the carriage 130 slides up within the rail 128. The carriage 130 is attached to the handle via the linkage 138. The carriage 130 is restrained to vertical linear motion via the rail 128. The mechanism engages with the waste discharge valve 106 when the carriage 130 captures the spring plunger 610 on the valve linkage arm 122. When the carriage 130 reaches the full stroke the waste discharge valve 106 is in the fully open position. When the user releases the handle, the carriage 130 slides downward returning the waste discharge valve 106 to the closed position and the handle to the non-operating position automatically.

FIG. 5 shows a front view of the toilet configured according to an embodiment. In the embodiment shown in FIG. 5, the handle 234 is positioned at the bottom center of the toilet. A person skilled in the art will understand that the handle 234 may be positioned elsewhere. For instance, the handle 234 in one embodiment may be positioned at a bottom left portion of the toilet or other arrangements located at the top, sides, or bottom of the toilet may be used to rotate the cam arm 140 to operate the manual flushing apparatus 120.

The foregoing discussion is directed to various exemplary embodiments. However, one possessing ordinary skill in the art will understand that the examples disclosed herein have broad application, and that the discussion of any embodiment is meant only to be an example of that embodiment, and not intended to suggest that the scope of the disclosure, including claims, is limited to that embodiment.

Certain terms are used throughout the foregoing description to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or somewhat schematic form and some details of the conventional elements may not be shown in interest of clarity and conciseness.

For the purposes of promoting an understanding of the principles of the disclosure, reference has been made to the embodiments illustrated in the drawings, and specific language has been used to describe these embodiments. However, no limitation of the scope of the disclosure is intended by this specific language, and the disclosure should be construed to encompass all embodiments that would normally occur to one of ordinary skill in the art.

The particular implementations shown and described herein are illustrative examples and are not intended to otherwise limit the scope of the disclosure in any way. For the sake of brevity, conventional electronics, control systems, software development, and other functional aspects of the systems and components of the individual operating components of the systems) may not be described in detail.

The steps of all the methods described herein are performable in any suitable order unless otherwise indicated herein or otherwise clearly contradicted by context. The use of any and all examples, or exemplary language (e.g., "such as") provided herein, is intended merely to better illuminate the disclosure and does not pose a limitation on scope unless otherwise claimed. Numerous modifications and adaptations will be readily apparent to those skilled in this art without departing from the spirit and scope of the disclosure.

It will also be recognized that the terms "comprises," "comprising," "includes," "including," "has," and "having" as used herein, are specifically intended to be read as open-ended terms of art. The user of the terms "a" and "an" and "the" and similar referents in the context of describing the techniques (especially in the context of the following claims) are to be construed to cover both the singular and the plural, unless the context clearly indicates otherwise. In addition, it should be understood that although the terms "first," "second," etc. may be used herein to describe various elements, these elements should not be limited by these terms, which are only used to distinguish one element from one another.

We claim:

1. An apparatus for controlling a waste outlet of a toilet, the apparatus comprising:

a motor-driven flushing apparatus and a manual flushing mechanism, the manual flushing mechanism comprising a flush handle configured to be operated upon, the flush handle coupled to a shaft, the shaft coupled to a carriage;

a valve linkage arm coupled to the flush handle, the valve linkage arm including a spring plunger at a first end;

a waste discharge valve disposed at the waste outlet of the toilet and coupled to a second end of the valve linkage arm;

wherein:

operation of the flush handle is configured to move the valve linkage arm in a first direction;

rotation of the flush handle is configured to vertically move the carriage in the first direction towards the spring plunger of the valve linkage arm;

when the flush handle is rotated, the carriage is configured to engage the spring plunger;

movement of the carriage in the first direction while the carriage is engaged with the spring plunger is configured to move the valve linkage arm in the first direction to move the waste discharge valve to an open position; and upon release of the flush handle, the carriage is configured to slide opposite the first direction to an original position and the valve linkage arm is configured to move in a second direction and to move the waste discharge valve to a closed position.

2. The apparatus of claim 1, wherein the valve linkage arm is coupled to a torsion spring configured to bias the valve linkage arm to a start-up position.

3. The apparatus of claim 2, wherein the start-up position of the valve linkage arm corresponds to the waste discharge valve being in the closed position.

4. The apparatus of claim 1, wherein when the flush handle is released:

the carriage disengages with the spring plunger of the valve linkage arm;

the valve linkage arm returns to a start-up position; and the waste discharge valve is moved to the closed position.

5. The apparatus of claim 4, wherein the valve linkage arm is coupled to a torsion spring configured to bias the valve linkage arm to the start-up position.

6. The apparatus of claim 5, wherein a bias force of the torsion spring is configured to disengage the spring plunger from the carriage.

7. The apparatus of claim 1, further comprising a frame and a housing attached to the frame, wherein the housing has a slot that contains the waste discharge valve.

8. The apparatus of claim 1, further comprising a frame and bowl attached to the frame, wherein the waste outlet is located in a lower portion of the bowl.

9. The apparatus of claim 8, further comprising a waste pipe attached to the bowl at the waste outlet.

10. The apparatus of claim 1, wherein the motor-driven flushing apparatus is configured to control the operation of the waste discharge valve without engaging the flush handle.

11. The apparatus of claim 1, wherein the flush handle is turned in a counter-clockwise direction.

12. The apparatus of claim 1, wherein the valve linkage arm is configured to automatically return the waste discharge valve to the closed position after the flush handle is released.

13. The apparatus of claim 1, wherein the valve linkage arm is configured to automatically bias the waste discharge valve to the closed position when the flush handle is not rotated.

14. The apparatus of claim 1, wherein the rotation of the flush handle is constrained by a front guide and a back support provided on a frame of the toilet.

15. A method for controlling a waste outlet of a toilet, the toilet comprising a flush handle, a valve linkage arm coupled to the flush handle, and a waste discharge valve coupled to the valve linkage arm, the method comprising:

rotating the flush handle to vertically move a carriage in a first direction towards a spring plunger of the valve linkage arm to engage the carriage and the spring plunger, wherein vertically moving the carriage comprises translating a rotational movement of the flush handle to a vertical movement of the valve linkage arm when the carriage and the spring plunger are engaged; and upon release of the flush handle, sliding the carriage opposite the first direction to an original position to control the waste discharge valve to go from an open position to a closed position via movement of the valve linkage arm opposite the vertical movement.

16. The method of claim 15, wherein the valve linkage arm is coupled to a torsion spring configured to bias the valve linkage arm to a start-up position.

17. The method of claim 16, wherein the start-up position of the valve linkage arm corresponds to the waste discharge valve being in the closed position.

18. The method of claim 15, wherein when the flush handle is released:

the carriage disengages with the spring plunger of the valve linkage arm;

the valve linkage arm returns to a start-up position; and the waste discharge valve is moved to the closed position.

19. The method of claim 18, wherein the valve linkage arm is coupled to a torsion spring configured to bias the valve linkage arm to the start-up position.

20. The method of claim 15, wherein a bias force of the torsion spring is configured to disengage the spring plunger from the carriage.

* * * * *